US006250943B1

(12) United States Patent
Castle et al.

(10) Patent No.: US 6,250,943 B1
(45) Date of Patent: Jun. 26, 2001

(54) CONNECTOR ASSEMBLY

(75) Inventors: Anthony E. Castle, Mechanicsburg; David T. Humphrey, York, both of PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/399,413

(22) Filed: Sep. 20, 1999

(51) Int. Cl.[7] ..... H01R 13/627
(52) U.S. Cl. ..... 439/352
(58) Field of Search ..... 439/352, 357, 439/358, 326, 329

(56) References Cited

U.S. PATENT DOCUMENTS 5,643,003 * 7/1997 Myer et al. ..... 439/352
5,688,142 * 11/1997 Dietz et al. ..... 439/487 X
5,690,507 * 11/1997 Grzybowski et al. ..... 439/464
5,759,058 * 6/1998 Childs et al. ..... 439/352
5,820,398 * 10/1998 Stabroth et al. ..... 439/352
5,938,470 * 8/1999 Kashiyama ..... 439/489
5,947,763 * 9/1999 Alaksin ..... 439/489 X
6,004,153 * 12/1999 Myer et al. ..... 439/352
6,071,153 * 6/2000 Fink et al. ..... 439/752

* cited by examiner

*Primary Examiner*—Brian Sircus
*Assistant Examiner*—Son V. Nguyen
(74) *Attorney, Agent, or Firm*—William H. McNeill

(57) ABSTRACT

A connector assembly is provided which includes a connector housing, at least one resilient lever pivotally attached relative to the connector housing, and a slider slidably attached to each lever. The connector housing is slidably engagable with and disengagable from a mating connector assembly in an engaged and disengaged mode, respectively. Each lever engages and disengages the mating connector assembly in such engaged and disengaged mode. The slider is movable to a first position to prevent disengagement of the lever from the mating connector assembly in a locked mode, and to a second position to allow disengaging the lever from the mating connector assembly in an unlocked mode.

16 Claims, 9 Drawing Sheets

CONNECTOR ASSEMBLY

TECHNICAL FIELD

The present invention relates to a connector assembly, and more particularly to a connector assembly that is useful as a harness connector assembly.

BACKGROUND ART

It is known to mate male and female connector assemblies. For example, automobile wiring systems typically include wiring harnesses. Each harness contains many conductors that are electrically and mechanically connected to respective contacts contained in harness connector housings. The harness connector housings and the plurality of contacts contained therein are mated with respective header connector housings and the contacts contained therein. In such applications, it is often desirable to mount or otherwise locate the connector assemblies in areas affording limited space. However, due to other requirements of the connector assemblies, this has been difficult to achieve. For example, in addition to function as connectors, the connector assemblies often are required to incorporate some sort of connector position assurance (CPA) to prevent mated connector assemblies from becoming accidentally disconnected. There is also a need that the connector assemblies be easy to use and readily engagable and disengagable relative to each other. All of the foregoing must be achieved without sacrificing strength and reliability. Such demands have necessitated that the connector assemblies be larger and more complicated than desired.

DISCLOSURE OF THE INVENTION

It is an object of the present invention to provide an improved connector assembly.

Another object of the present invention is to obviate the disadvantages of the prior art.

A further object of the present invention is to provide a connector assembly that may be mounted or otherwise located in areas affording limited space yet is easy to use and is readily engagable and disengagable relative to a mating connector assembly.

Yet another object of the present invention is to provide a connector assembly which may be mounted or otherwise located in areas affording limited space yet includes a CPA.

Another object of the present invention is to provide a connector assembly that meets one or more of the foregoing objectives yet has acceptable strength and reliability.

A further object of the present invention is to provide a harness connector assembly that achieves all of the foregoing objectives.

The present invention achieves these and other objects by providing a connector assembly that comprises a connector housing slidably engagable with and disengagable from a mating connector assembly in an engaged mode and a disengaged mode, respectively. At least one resilient lever is pivotally attached relative to the connector housing and comprises a first end and an opposite second end. The first end engages and disengages the mating connector assembly in the engaged mode and the disengaged mode, respectively. A slider is slidably attached to the lever for sliding between the first end and the second end thereof. The slider is structured and arranged to slide in a first direction to a first position, to prevent disengagement of the lever from a mating connector assembly, in a locked mode, and to slide in an opposite second direction to a second position to provide a pressure point for pivoting the lever to provide disengagement of the lever from the mating connector assembly in an unlocked mode.

BRIEF DESCRIPTION OF THE DRAWINGS

This invention may be clearly understood by reference to the attached drawings in which like reference numerals designate like parts and in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

The connector assembly of the present invention comprises a connector housing having at least one resilient lever attached thereto. Each lever comprises a first end and an opposite second end. A slider is slidably attached to each lever for sliding between the first and second ends thereof. The connector housing of the connector assembly of the present invention is slidably engagable with and disengagable from a mating connector assembly in an engaged and disengaged mode, respectively. The first end of each lever attached to the connector housing engages and disengages the mating connector assembly in the engaged and disengaged modes, respectively. The slider is structured and arranged to slide in one direction to a first position, to prevent disengagement of the lever from a mating connector assembly, in a locked mode, and to slide in an opposite direction to a second position, to provide a pressure point for pivoting the lever to provide disengagement of the lever from the mating connector assembly, in an unlocked mode. Without limitation, the connector assembly of the present invention may be a harness connector assembly of the type used in automobile wiring systems. In such an automobile wiring system, various bundles of wires forming conventional wiring harnesses are electrically and mechanically connected to respective contacts in a harness connector housing in a conventional manner. Each harness connector housing and the contacts therein is adapted for connection to a respective mating connector housing, in the form of a header connector housing, and contacts therein, of a header connector assembly. The contacts of the header connector assembly are typically electrically and mechanically connected to a circuit such as may be provided by a circuit board.

Figure 1:
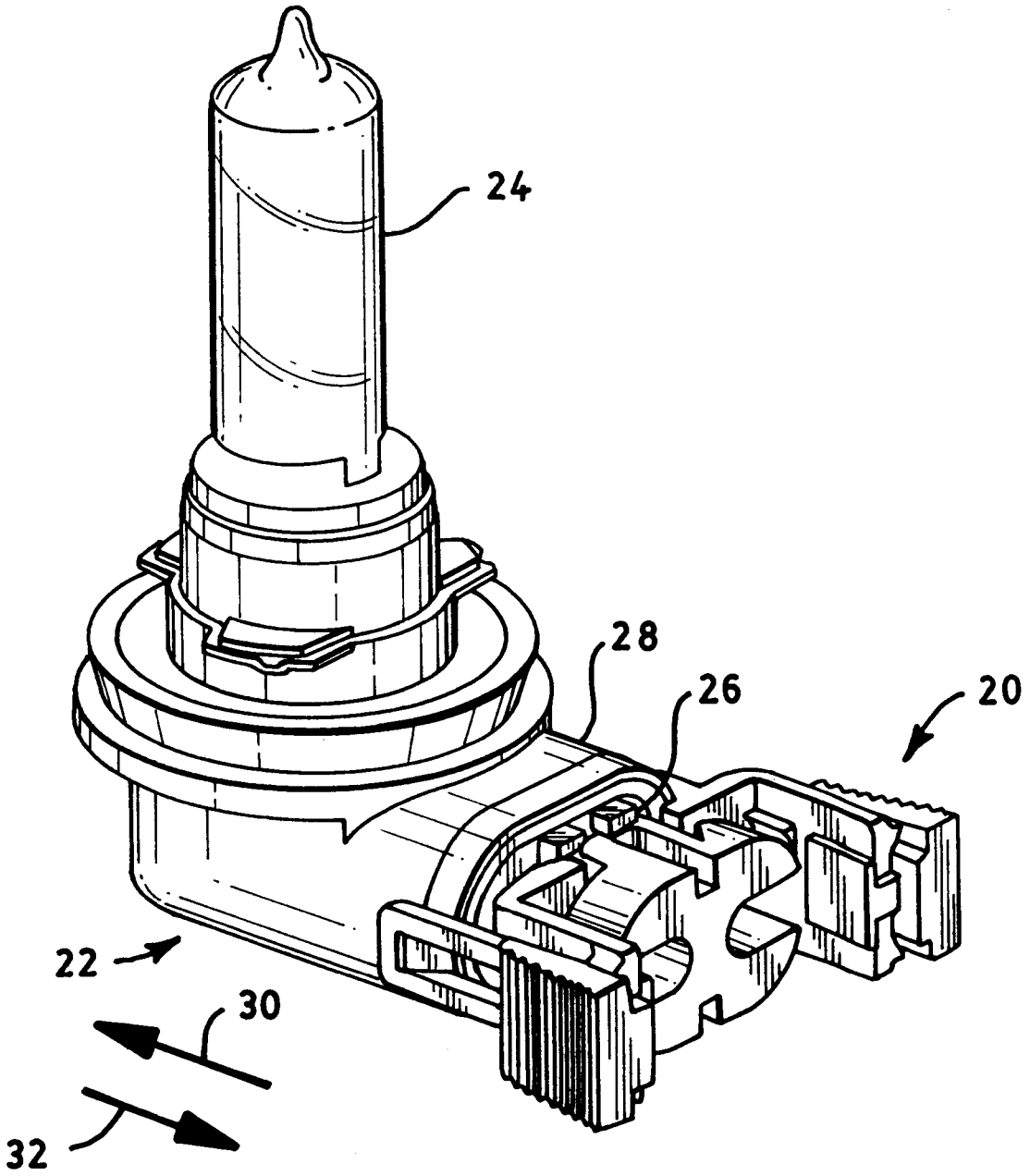
FIG. 1 is a perspective view of one embodiment of a harness connector assembly of the present invention engaged with a mating header connector assembly.

Referring to the drawings, FIG. 1 illustrates one embodiment of the connector assembly of the present invention slidably engaged with a mating connector. In particular, FIG. 1 illustrates a harness connector assembly 20 slidably engaged with a mating header connector assembly 22. A lamp 24 is electrically and mechanically attached to the header connector assembly 22. Contacts (not shown) in the harness connector assembly 20 and header connector assembly 22 are connected together in a conventional manner. The contacts in the harness connector assembly 20 may be connected in a conventional manner to respective conductors (not shown) which form a typical wiring harness. The contacts in the header connector assembly 22 may be connected in a conventional manner to a circuit such as a printed circuit (not shown). In the embodiment illustrated in FIG. 1, the harness connector assembly 20 comprises a connector housing 26 which is slidably engagable with and disengagable from a mating connector housing 28 of the mating header connector assembly 22 in the directions 30 and 32 in an engaged mode and a disengaged mode, respectively.

Figure 2:
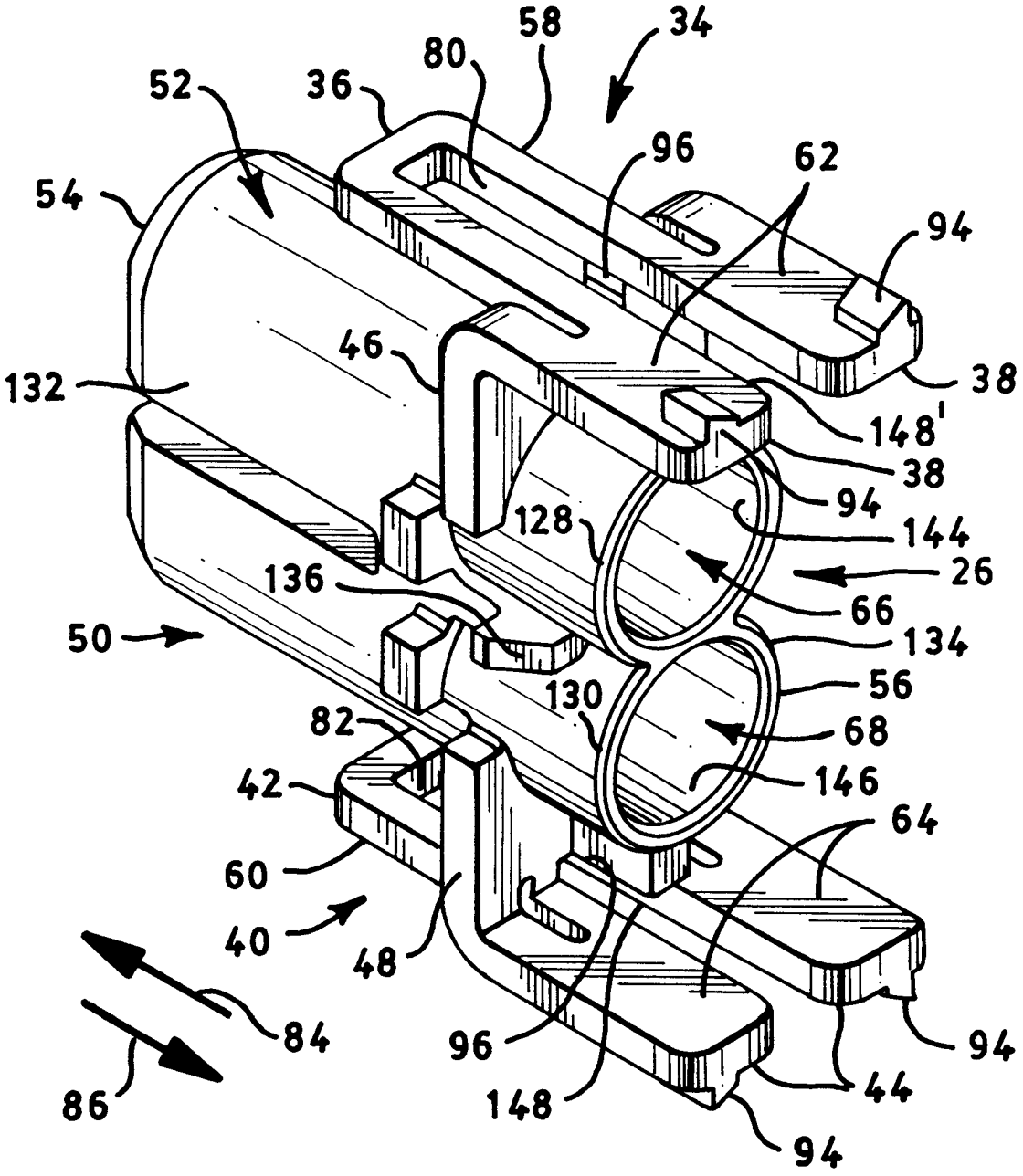
FIG. 2 is a perspective view of the connector housing and levers attached thereto of the harness connector assembly illustrated in FIG. 1.

FIG. 2 illustrates the connector housing 26 of FIG. 1 having resilient levers attached thereto. In particular, a resilient first lever 34 is attached to the connector housing 26. Lever 34 includes a first end 36 and an opposite second end 38. An identical second lever 40 is attached to the connector housing 26. Lever 40 includes a first end 42 and an opposite second end 44. Ends 36 and 42 of levers 34 and 40 are structured and arranged as described hereinafter to engage and disengage the connector assembly 22 in the engaged and disengaged modes, respectively. The levers 34 and 40 are pivotally attached relative to the connector housing 26 by respective pairs of beams 46 and 48 which extend from respective side portions 50 and 52 of the housing between a front end 54 and an opposite rear end 56. The first ends 36 and 42 of the levers 34 and 40 extend towards the front end 54, and the second ends 38 and 44 extend away from the front end. In the embodiment illustrated in FIG. 2, levers 34 and 40 comprise respective first lengths 58, 60 which are cantilevered towards respective ends 36 and 42, and respective pairs of second lengths 62,64 which are cantilevered towards respective ends 38 and 44. Positioning the levers 34 and 40 at the sides 52 and 50 of the housing 26 allows for a very low profile top and bottom portion of the connector assembly. Housing 26 comprises openings 66, 68 into which conductors may be inserted for connection in a conventional manner to contacts contained within the housing.

Figure 3:
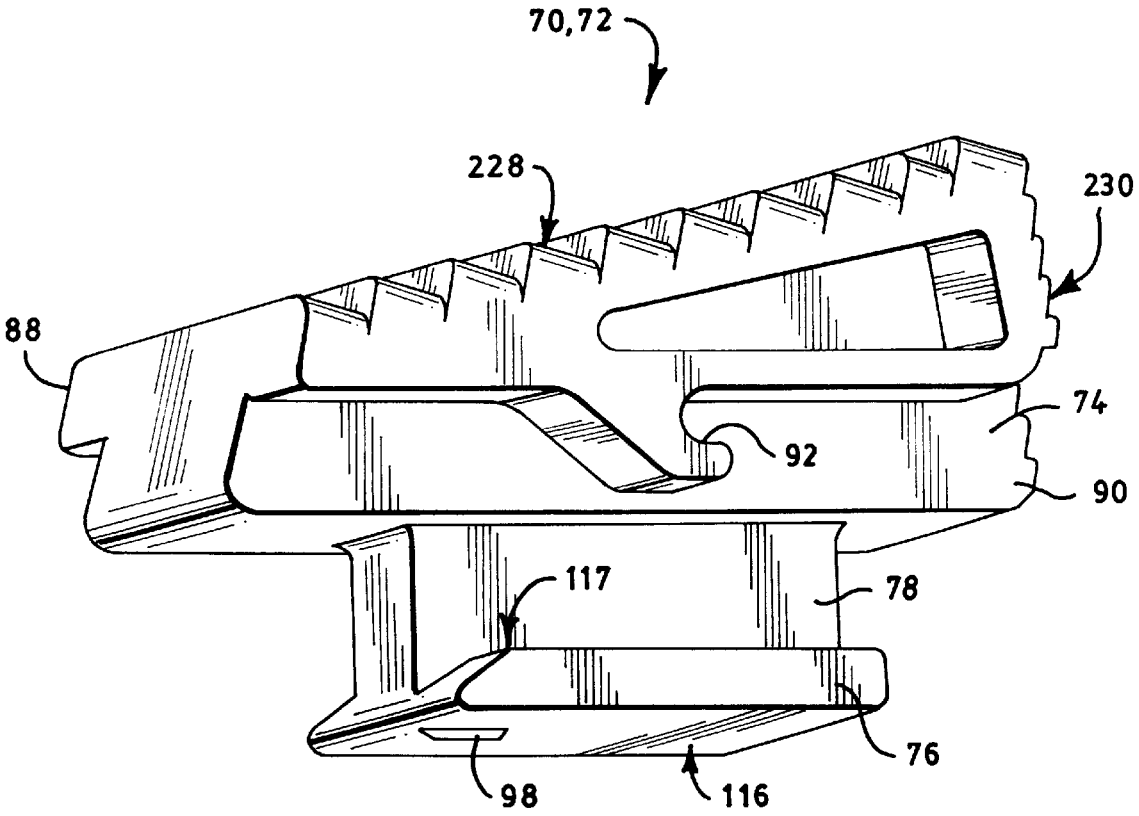
FIG. 3 is a perspective view of the type of slider attached to the levers of the harness connector assembly illustrated in FIG. 1.
Figure 4:
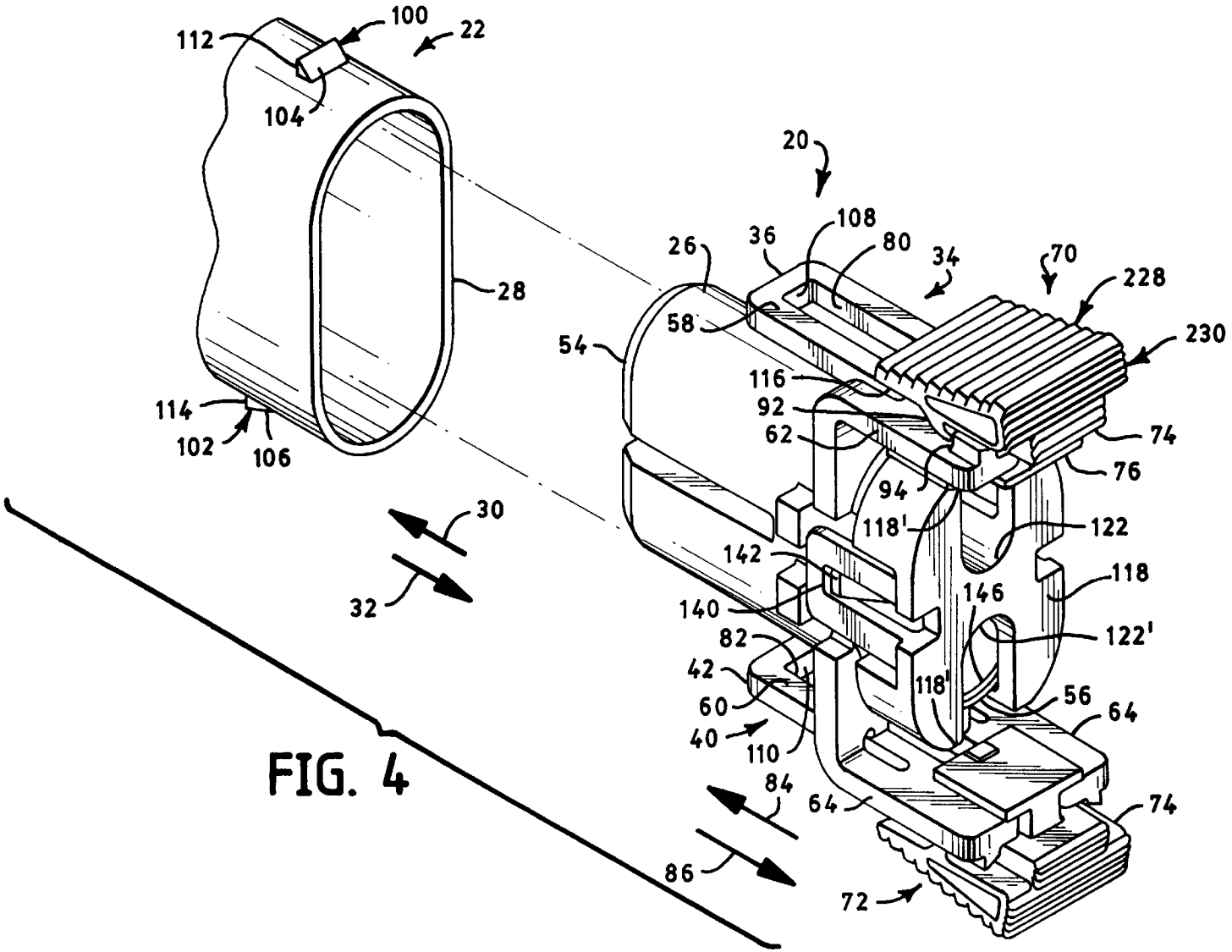
FIG. 4 is a perspective view of the harness connector assembly illustrated in FIG. 1 disengaged relative to the mating header connector assembly.

The connector assembly of the present invention comprises sliders attached to the resilient levers. For example, FIG. 3 is illustrative of the two sliders 70,72 slidably attached to respective levers 34 and 40 as illustrated in FIG.4. Each slider includes a finger pad 74 comprising non-slip grooves and an easy to grip shape. The finger pad 74 is coupled to a base 76 by a pedestal 78. The pedestal 78 is dimensioned to fit in a slot 80,82 of the levers 34 and 40 so that the levers are sandwiched between the bottom of the finger pad 74 and the base 76, as illustrated in FIG. 4, and can slide in directions 84 and 86 along respective slots 80 and 82. Each side 88, 90 of the sliders 70,72 includes an abutment surface 92, and the lever lengths 62 and 64 include pairs of mating abutment surfaces 94. The levers 34 and 40, and the sliders 70,72 are dimensioned such that the sliders may be attached to the levers by inserting the respective pedestal 78 in direction 84 into a respective slot 80 and 82 until the abutment surfaces 92 are cammed or otherwise snap beyond the mating abutment surfaces 94. When a slider has been attached to each lever in this manner, removal of the slider from the slot, when the slider is moved in direction 86, will be prevented by the engagement of the abutment surfaces 92 with a mating abutment surface 94.

Each slider 70, 72 function as a connector position assurance (CPA) device. To this end the sliders 70,72 may be slid in direction 84 to lock in place the levers 34 and 40, in a locked mode, and in direction 86 to unlock the levers, in an unlocked mode, as described hereinafter. An additional safety feature may be provided which assures that the sliders stay in the locked mode. To this end, the connector housing 20 is provided with latch members and each slider is provided with a mating latch member. Without limitation, the latch members of the connector housing 20 are in the form of indentations 96, in respective side protuberances 148 148', attached to respective side portions 50, 52 of the connector housing 26, as illustrated in FIG. 2, and the mating latch members of the sliders 70, 72 are in the form of dimples 98 extending from the bottom of respective bases 76, as illustrated if FIG. 3. The indentations 96 and the dimples 98 are structured and arranged such that when the sliders 70, 72 are moved in direction 84 and lock the levers 34, 40 in place in a locked mode, each dimple 98 will sit in or otherwise engage a respective indentation 96 and prevent any accidental movement of the sliders 70,72 as might occur due to vibration or shaking of the connector assembly 20. The indentations 96 and dimples 98 may be dimensioned such that the slider can be easily moved out of the locked mode if the user applies sufficient force in direction 86 to force the dimples out of engagement with the indentations thereby permitting sliding of the sliders 70,72 in direction 86 in an unlocked mode. In this manner the indentations 96 and dimples 98 may be removably engaged so as to prevent accidental movement of the sliders 70,72 yet permit the user to force movement of the sliders if desired.

In use, if not already in position, the user may grasp each finger pad 74 of the sliders 70,72 between a thumb and a forefinger and move the sliders in direction 86 until the abutment surfaces 92 engage respective mating abutment surfaces 94 as illustrated in FIG. 4. When the sliders are in this location, the harness connector assembly 20 of the present invention may be slidably engaged with the mating header connector assembly 22. To this end, the user continues to grasp each finger pad 74 between a thumb and a forefinger and pushes the connector assembly 20 in direction 30 to insert harness connector housing 26 into the mating header connector housing 28 thereby electrically and mechanically connecting the contacts contained in the header and harness connector housings in a conventional manner. During such sliding engagement, the ends 36 and 42 of the resilient levers 34 and 40 will engage respective protuberances 100,102 of the housing 28 and be automatically cammed apart by respective surfaces 104, 106. When the contacts are fully mated, the levers 34 and 40 will resile to their relaxed orientation such that surfaces 108, 110 of the levers engage abutment surfaces 112, 114 of the protuberances 100,102 to automatically fasten the housings 26 and 28 in place in the engaged mode.

The user may then urge the sliders 70,72 in direction 84 until the indentations 96 and the dimples 98 are engaged in the locked mode. Such movement of the sliders 70,72 is in the same direction as the direction in which the connector housing 26 was moved when engaged with the mating connector housing 28. When in this position, the sliders 70,72 prevent pivoting of respective levers 34 and 40 so as to prevent disengagement of the lever surfaces 108, 110 from the abutment surfaces 112, 114 in the locked mode. To this end, the bottom 116 of the base 76 engages the protuberances 148 and 148' and the top 117 of the base 76 engages the lengths 58, 60 of the levers 34,40 to prevent sufficient downward pivotal movement of the lever ends 38, 44 and thereby prevent upward pivotal movement of the lever ends 36, 42 to disengage the lever ends from the protuberances 100,102.

When it is desired to disengage the harness and header connector assemblies 20, 22, the user grasps the finger pads 74 and urges the sliders 70,72 in direction 86 sufficiently to overcome the engagement of the indentations 96 and dimples 98 thereby moving the sliders in direction 86 until the abutment surfaces 92 engage respective mating abutment surfaces 94. The user then uses the finger pads 74 of sliders 70,72 as opposing pressure points to pivot the pairs of lengths 62,64 of the levers 34,40 towards each other thereby pivoting the lengths 58,60 upward and away from each other to provide disengagement of the surfaces 108,110 from the abutment surfaces 112,114 in the unlocked mode. The user may then pull the harness connector assembly 20 in direction 32 to disengage the harness connector assembly from the header connector assembly 22 in the disengaged mode. The use of two levers 34,40 and opposing finger pads 74 improves the strength and reliability of the connector assembly 20. Furthermore, the "squeeze" release action is better ergonomically than latch releases that require lifting or pulling outward on opposing latches, as in the prior art.

Figure 5:
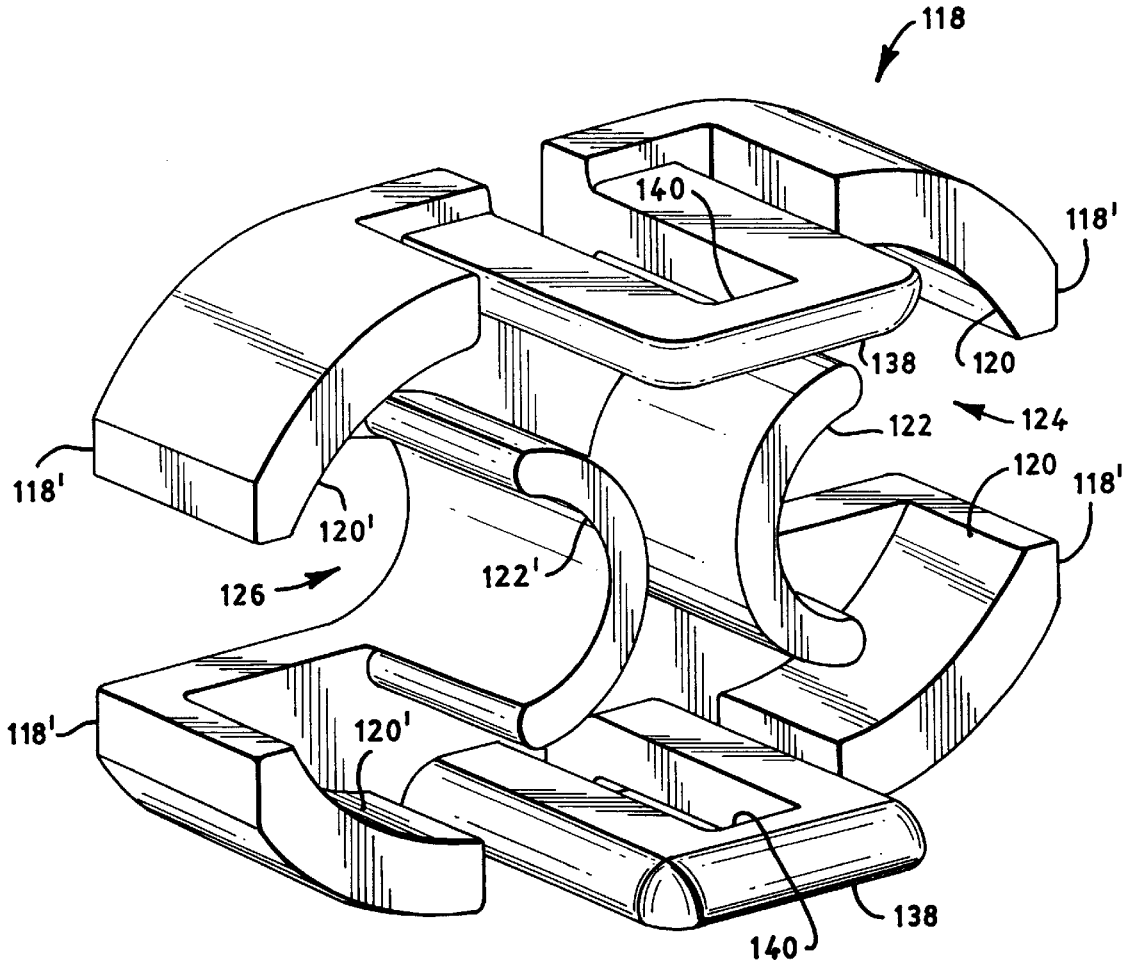
FIG. 5 is a perspective view of a conductor strain relief member of the type illustrated in FIG. 1.

The connector assembly of the present invention may comprise a conductor strain relief member that is removably engagable with the connector housing at the rear end thereof Such conductor strain relief member may comprise at least one opening that is structured and arranged to effect a straddle slip fit of a length of conductor extendable therethrough. For example, in the embodiment illustrated in FIG. 4, the connector assembly 20 comprises a conductor strain relief member 118 that is removably engagable with the connector housing 26 at the rear end 56. Details of the conductor strain relief member 118 are illustrated in FIG. 5. The conductor strain relief member 118 illustrated in FIG. 5 includes two pairs of arcuate portions 120, 120', each pair facing a respective arcuate portion 122, 122' to provide respective openings 124 and 126 and to mate with respective tubular portions 128 and 130 illustrated in FIG. 2 and retain the conductors by trapping the contacts and seals crimped to the wire conductor in the harness connector. In particular, arcuate portions 120, 120' mate with the outer surface of tubular members 128 and 130, respectively, and arcuate portions 122,122' extend into respective openings 66,68 of tubular members 128 and 130. FIG. 4 illustrates the conductor strain relief member 118 coupled to the connector housing 26 in this manner.

In order to provide removable engagement between the connector housing and the conductor strain relief member, the connector housing may comprise latch elements, and the conductor strain relief member may comprise opposing latch elements, structured and arranged to engage each other. For example, in the embodiment illustrated in FIG. 2, the connector housing 26 comprises a top portion 132 and an opposite bottom portion 134 between which extend side portions 50 and 52. The top portion 132 comprises a latch element 136 and the bottom portion 134 includes an identical latch element 136 (not visible in the drawings). With reference to FIG. 5, the conductor strain relief member 118 comprises opposing resilient latch elements 138. In use, respective conductors (not shown) will extend through the openings 124, 126, into openings 66,68 of tubular members 128, 130, and be connected to contacts contained within housing 26. In order to provide strain relief for the conductors, the conductor strain relief member 118 may be urged in direction 84 such that the latch elements 136 cam respective mating latch elements 138 away from each other, until the arcuate portions 120,120' and 122,122' are fully mated with respective tubular portions 128,130. When such mating is completed, the mating latch elements 138 will resile to their relaxed orientation such that the surface 140 of each mating latch 138 will snap in place against a respective abutment surface 142 of each latch element 136, as illustrated in FIG. 4, to hold the conductor strain relief member 118 in place against the connector housing 26. Strain relief is provided by trapping the contact, and elastomeric seals crimped to the wire conductors that are inserted into respective openings 66,68 of tubular members 128 and 130, with the arcuate portions, 122, 122'.

In the embodiment illustrated in FIGS. 1 to 5, a connector assembly is provided having two opposing levers 34,40 each having a slider 70,72 slidably attached thereto. In an alternative embodiment illustrated in FIG. 6 a harness connector assembly 200 is provided having one lever 202 and one slider 204. The slider 204 is slidably attached to the lever 202 in the same manner in which the sliders 70,72 are attached to respective levers 34,40 and operates in essentially the same manner. The connector assembly 200 provides strength, simplicity and a lower profile relative to the embodiment illustrated in FIGS. 1 to 5 and is particularly useful in smaller harness applications. To this end, the connector assembly 200 is particularly useful to accommodate a header connector assembly having a very low profile in either width and/or height. This feature is particularly useful in some automotive lamp applications that are mounted in very small areas.

Figure 6:
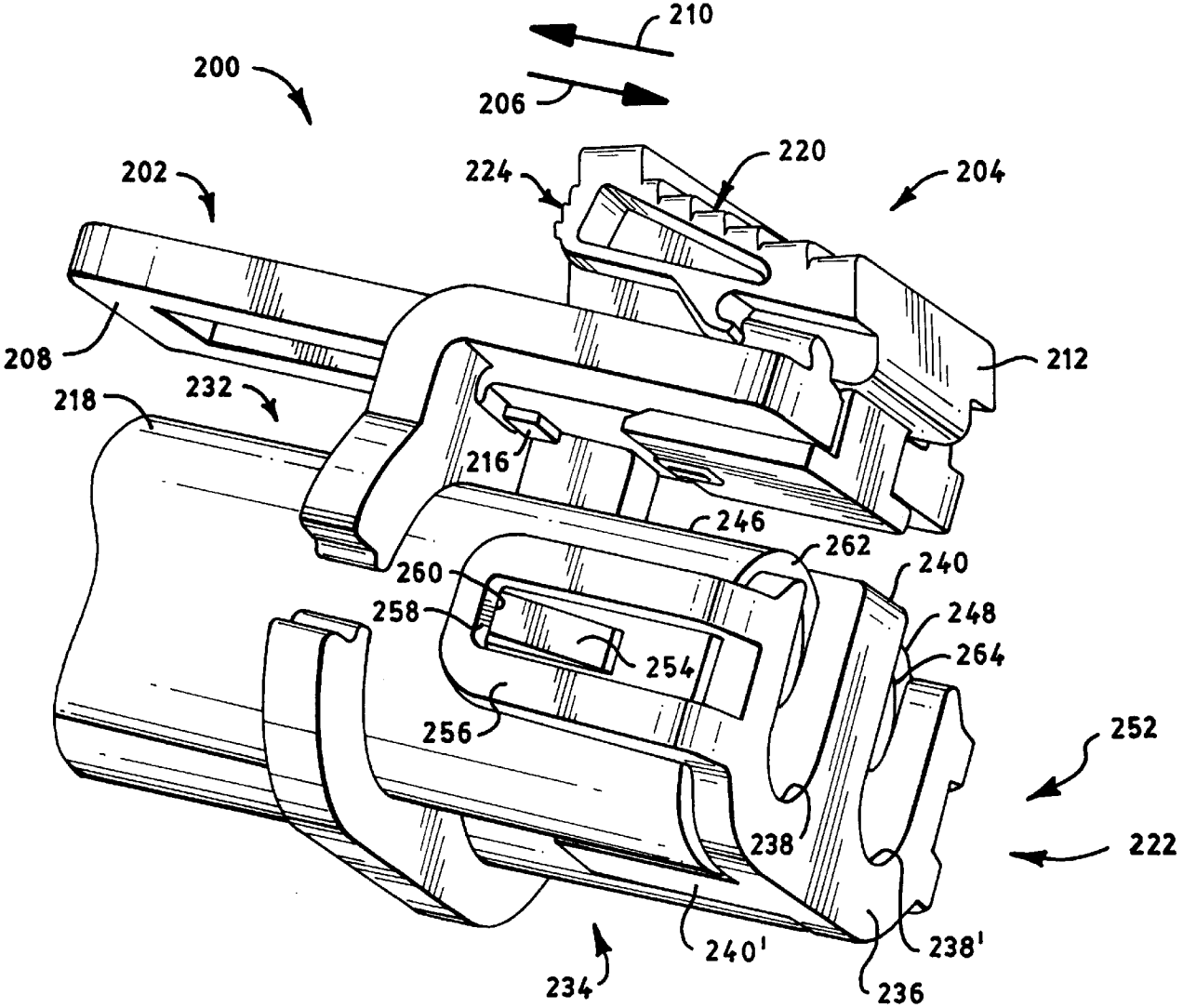
FIG. 6 is a perspective view of an alternative embodiment of a harness connector assembly of the present invention.

In use, the harness connector assembly 200 can be slidably engaged with a mating header connector assembly by moving the slider 204 in direction 206 to the unlocked position illustrated in FIG. 6 and then pushing the harness connector assembly 200 into engagement with the header connector assembly as described with respect to the embodiment of FIGS. 1 to 5. When the harness and header connector assemblies are fully mated, the end 208 of the lever 202 will resile into engagement with a protuberance of the header connector assembly in an engaged mode in a manner which is similar to the manner in which the ends 36, 42 of levers 34,40 engage protuberances 100,102 in the embodiment illustrated in FIG. 4. The slider 204 may then be moved in direction 210 to the locked position to prevent pivoting of the lever 202, sufficient to disengage the end 208 from such protuberance, in a locked mode similar to the locked mode described with respect to the embodiment of FIGS. 1 to 5.

Figure 7:
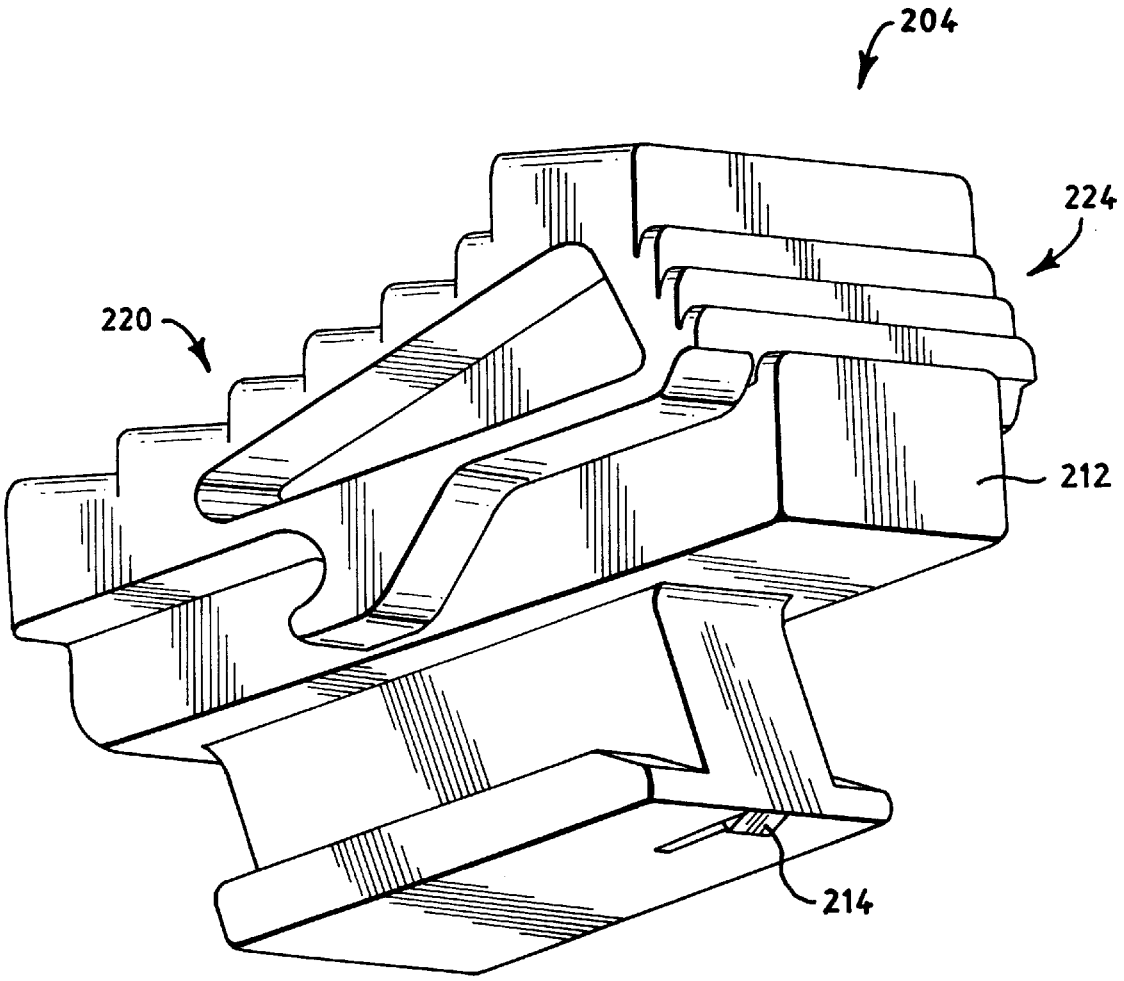
FIG. 7 is a perspective view of a slider of the type attached to the lever of the harness connector of FIG. 6.

The details of slider 204 are illustrated in FIG. 7. The slider 204 includes a finger pad 212 having grooves. Finger pad 212 provides the same functions as the finger pad 74 of sliders 70,72. Slider 204 includes a dimple 214 that engages an indentation 216 in the connector housing 218 of the harness connector assembly 200 illustrated in FIG. 6. When the slider 204 is moved in direction 210 to a locked mode, the dimple 214 engages the indentation 216 to hold the slider in place relative to the lever 202 in the locked mode. For ease of use, the upper surface 220 of the finger pad 212 is angled downwardly towards the rear end 222 of the connector housing 218, and the surface 224 faces towards the front end 226. In contrast, the upper surface 228 of finger pads 70,72 are angled downwardly towards the front end 54 of the connector assembly 26, and the surface 230 faces away from the rear end 56.

Disengagement of the harness connector assembly 200 from the header connector assembly is also effected in a manner similar to that of the embodiment of FIGS. 1 to 5. In particular, the user urges the slider 204 in direction 206 sufficiently to overcome the engagement of the dimple 214 and the indentation 216 in the connector housing 218 thereby moving the slider to the unlocked mode illustrated in FIG. 6. The user then depresses the finger pad 212 to cause disengagement of the end 208 of the lever 202 from the protuberance in the header connector assembly in a manner similar to which the ends 36,42 of levers 34,40 are disengaged from protuberances 100, 102 in the embodiment illustrated in FIG. 4. The user may then pull the harness connector assembly 200 away from the header connector assembly to disengage the two from each other in the disengaged mode.

In the embodiment illustrated in FIG. 6, the connector housing 218 comprises a top portion 232 and an opposite bottom portion 234. The lever 202 is pivoted from the top portion 232 in a manner similar to which the levers 34,40 of the embodiment of FIGS. 1 to 5 are pivoted to respective side portions 52,50 of the connector housing 26. Such configuration provides a harness connector assembly having a relatively narrow width profile, the lever being positioned at the top portion rather than the side portions.

Figure 8:
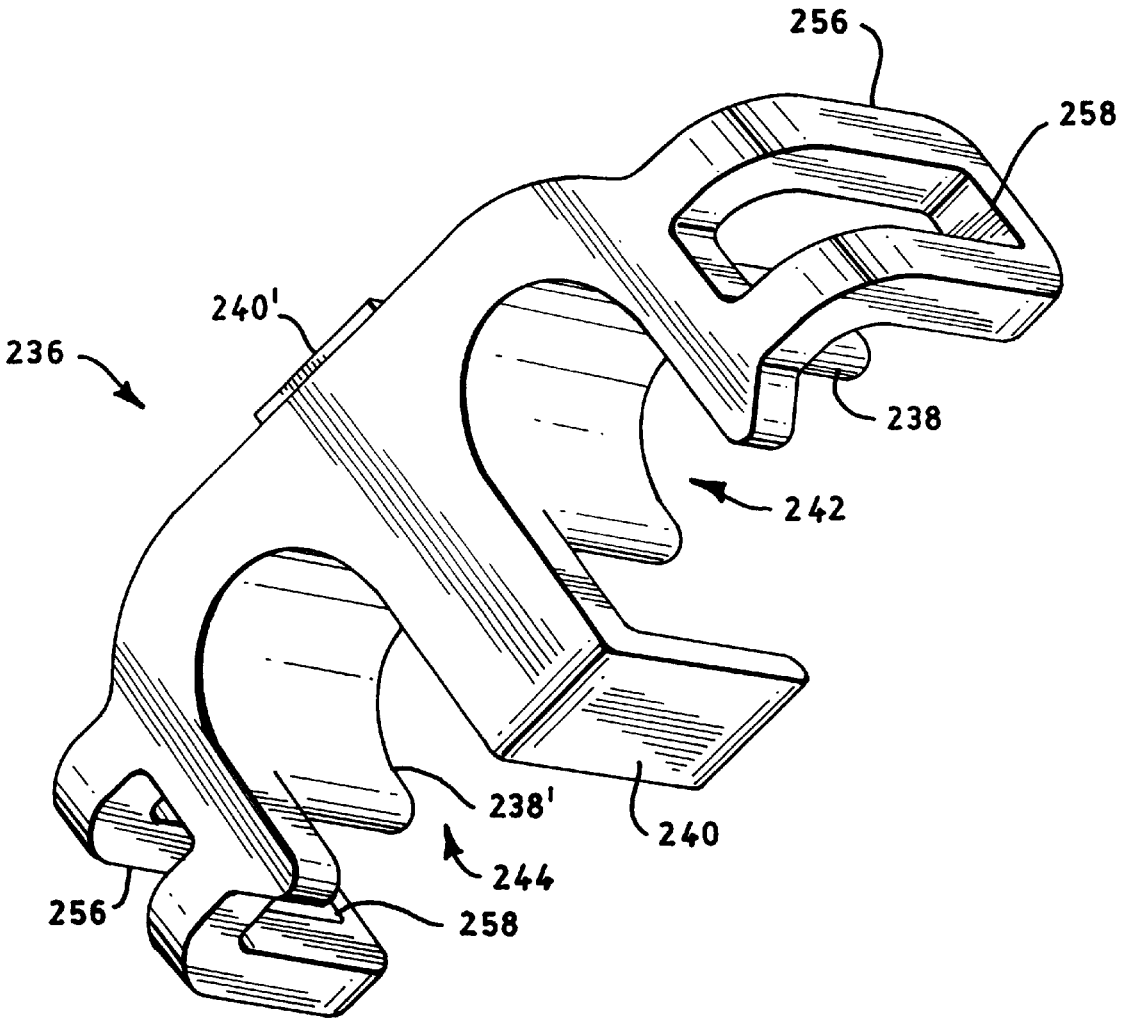
FIG. 8 is a perspective view of a conductor strain relief member of the type illustrated in FIG. 6.

The harness connector assembly 200 may comprise a conductor strain relief member which functions in the same manner as the conductor strain relief member 118 of the embodiment of FIGS. 1 to 5. For example, FIG. 6 illustrates a conductor strain relief member 236 that is removably engagable with the connector housing 218 at the rear end 222. Details of the conductor strain relief member 236 are illustrated in FIG. 8. The conductor strain relief member 236 comprises arcuate portions 238, 238' and beams 240,240' which are structured and arranged to provide openings 242 and 244 and to mate with respective tubular portions 246 and 248 of the connector housing 218. In particular, as illustrated in FIG. 6, the beams 240 and 240' grasp or otherwise mate with the tubular portions 246, 248 where such tubular portions are adjacent to each other, and the arcuate portions 238,238' extend into the openings of the tubular members 246,248.

In order to provide removable engagement between the connector housing and the conductor strain relief member, the connector housing comprises latch elements, and the conductor strain relief member comprises opposing latch elements, structured and arranged to engage each other. For example, in the embodiment illustrated in FIGS. 6 and 8, the connector housing 218 comprises a side portion 250 and an opposite side portion 252 between which extend top portions 232 and bottom portion 234. The side portion 250 comprises a latch element 254 and the side portion 252 includes an identical latch element 254 (not visible in the drawings). With reference to FIG. 8, the conductor strain relief member comprises opposing resilient latch elements 256. In use, respective conductors (not shown) will extend through the openings 242,244 of the conductor strain relief member 236, into the tubular members 246,248, and be connected to contacts contained within housing 218. In order to provide strain relief for the conductors, the conductor strain relief member 236 may be urged in direction 210 such that the latch elements 254 cam respective mating latch elements 256 away from each other until the arcuate portions 238, 238' are fully within, and the beams 240 and 240' are mated with, respective tubular portions 246,248. When such insertions and mating is completed, the mating latch elements 256 will resile to their normal orientation such that the surface 258 of each mating latch element 256 will snap in place against a respective abutment surface 260 of each latch element 254 to hold the conductor strain relief member 236 in place against the connector housing 218. Strain relief is provided as in the embodiment of FIGS. 1 to 5 by trapping the contacts and elastomeric seals crimped to the wire conductors that are inserted into the respective openings in tubular members 246, 248 with the arcuate portions 238, 238'.

Figure 9:
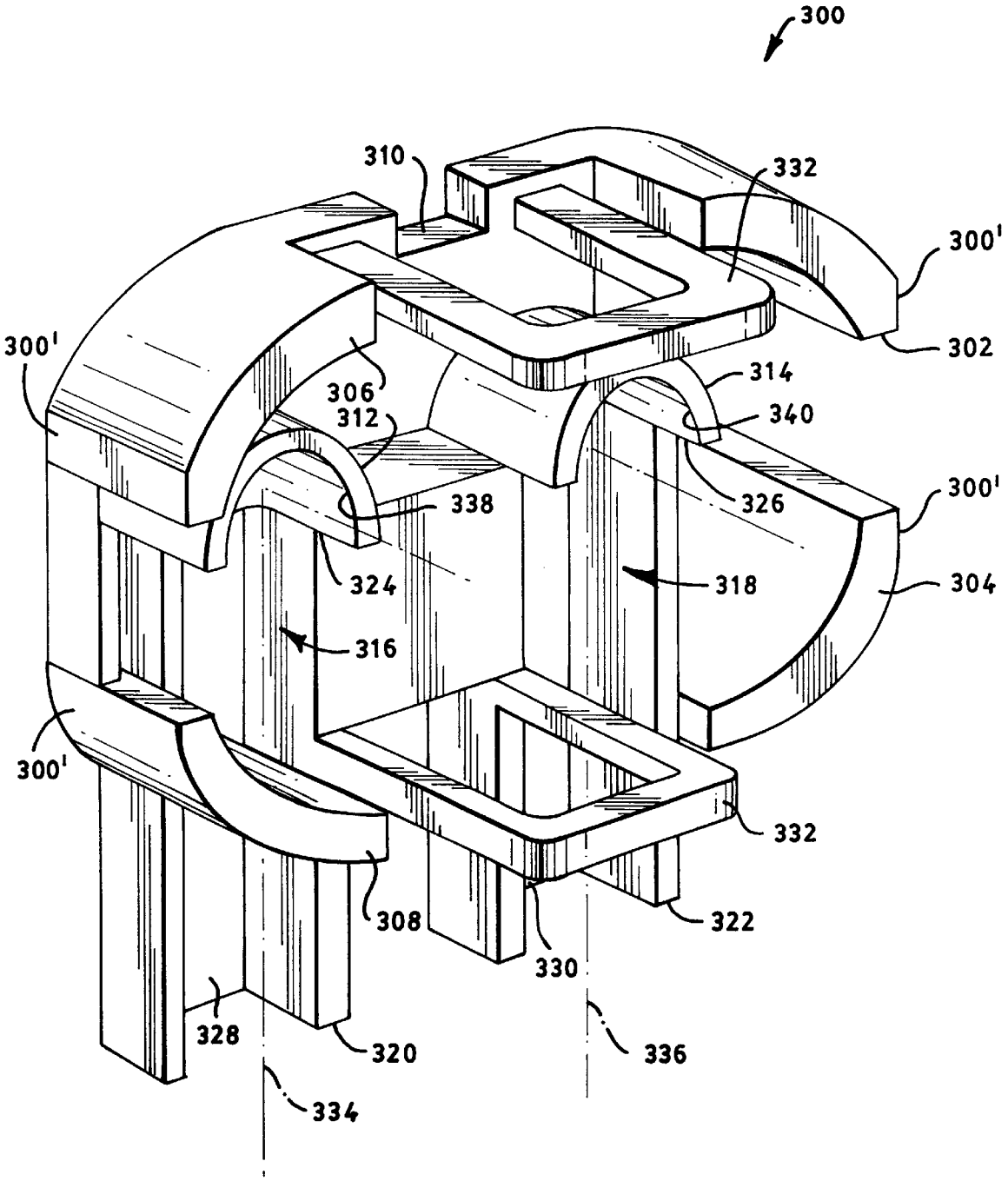
FIG. 9 is a perspective view of an alternative strain relief member of the present invention for providing a right-angle exit of the wires.

FIG. 9 illustrates an alternative embodiment of a conductor strain relief member 300 of the present invention. The strain relief member 300 comprises opposing pairs of arcuate portions 302,304 and 306,308, extending from a base 310, similar to arcuate portions 120,120' of the embodiment illustrated in FIG. 5. Two additional arcuate portions 312, 314 extend from base 310. Two channels 316,318 are provided at base 310 and extend from respective ends 320,322 to opposite ends 324,326. The bases 328,330 of the channels 316,318 are concave. The strain relief member 300 further includes resilient latch elements 332 extending from base 310 similar to latch elements 138 of the embodiment illustrated in FIG. 5. The channels 316, 318 and the arcuate portions 312,314 are structured and arranged to receive respective conductors which may be inserted therein and bent at 90° as illustrated in phantom lines at 334 and 336. The strain relief member 300 may be structured and arranged such that it may be attached to a connector assembly of the present invention by inserting the arcuate portions 312,314 into tubular portions of a connector housing such as the tubular portions 128,130 of housing 26 of the embodiment of FIGS. 1 to 5. Similarly, the latch elements 332 may be structured and arranged to engage mating latch elements such as mating latch elements 136 of housing 26.

In use, after the conductors 334,336 are inserted at 90° into the strain relief member as described above, the arcuate portions 312,314 may be inserted into the openings 66 and 68 of the tubular portions 128,130 such that the length of each conductor 334,336 which is disposed within the arcuate portions 312 or 314 is sandwiched between a respective concave surface 338,340 of arcuate portions 312,314 and an arcuate surface 144,146 of a tubular member 128,130. The contact retension strain relief is provided as in the embodiment of FIGS. 1 to 5 by trapping the contacts and elastomeric seals, crimped to the wire conductors that are inserted into the respective openings in tubular members 246, 248 with the arcuate portions 238, 238'.

In considering all of the conductor strain relief members 118, 236 and 300, each may include at least one lever abutment surface that provides a barrier for overstress protection of the lever(s) of the connector assembly of the present invention. For example, the strain relief member 118 illustrated in FIGS. 4 and 5 includes respective flat surfaces 118' which limit the pivotal movement of lengths 62,64 of levers 34,40 towards each other, as illustrated in FIG. 4. The strain relief member 300 comprises similar flat surfaces 300'. Similarly, the strain relief member 236 illustrated in FIGS. 6 and 8 includes a flat surface provided by beam 240 which limits downward pivotal movement of the segment of the lever 202 adjacent to the beam.

Fabrication of the connector assembly of the present invention may be accomplished using conventional procedures. For example, the connector housing with levers attached thereto, the slider and the conductor strain relief member may be molded from a plastic material. A straight draw mold may be used if desired.

The present invention provides a compact connector assembly that is easy to use and functions in a reliable manner when engaging and locking, and unlocking and disengaging mating connector assemblies. The connector assembly of the present invention is particularly useful as a harness connector assembly. Such harness connector assembly is useful in automobile applications, and without limitation, is useful as a module harness and as a headlamp harness connector assembly to be used with a headlamp header connector assembly whether the headlamp is large or small. The simple, effective and compact nature of the connector assembly of the present invention makes it suitable for a broad range of connector applications, whether large or small, and may be used to replace many existing connector assemblies. The relatively small size in combination with the CPA locking feature provides a connector assembly having safety features when it is necessary to locate the connector assembly in an area affording limited space. The slider-type CPA of the present invention serves multiple functions. In particular, in addition to providing a locking mechanism for the engaged connector assembly, the slider also provides a comfortable pressure point for the users fingers and has an easy to grip shape that facilitates manipulation of the slider.

The embodiment illustrated in FIGS. 1 to 5 illustrates a connector assembly having two opposing levers located respectively at opposite side portions of the connector housing. It will be evident to those skilled in the art that such levers could readily be located at the top and bottom portions of the connector assembly, if desired. Similarly, the embodiment of FIGS. 6 to 8 illustrates a connector assembly having a single lever at the top portion of the connector housing. It will be equally evident to those skilled in the art that such lever could readily be located at the bottom portion. Other lever orientation and placement is also possible.

The embodiments which have been described herein are but some of several which utilize this invention and are set forth here by way of illustration but not of limitation. It is apparent that many other embodiments that will be readily apparent to those skilled in the art may be made without departing materially from the spirit and scope of this invention.

What is claimed is:

1. A connector assembly, comprising:

a connector housing slidably engagable with and disengagable from a mating connector assembly in an engaged mode and disengaged mode, respectively;

at least one resilient lever pivotally attached relative to said connector housing and comprising a first end and an opposite second end, said first end engaging and disengaging said mating connector assembly in said engaged mode and said disengaged mode, respectively;

a slider slidably attached to said at least one lever for sliding between said first end and said second end, said slider being structured and arranged to slide in a first direction to a first position to prevent disengagement of said at least one lever from a mating connector housing, in a locked mode, and to slide in an opposite second direction to a second position to provide a pressure point for pivoting said at least one lever to provide disengagement of said at least one lever from a mating connector housing, in an unlocked mode, and wherein said connector housing comprises at least one side protuberance and said slider has a bottom surface that engages said protuberance when said slider is in said first position to prevent pivoting of said at least one lever, said bottom surface being disengaged from said at least one protuberance when said slider is in said second position.

2. The connector assembly of claim 1 wherein said connector housing comprises a latch member and said slider comprises a mating latch member, said latch member being engaged with said mating latch member in said locked mode.

3. The connector assembly of claim 2 wherein said latch member is removably engaged with said mating latch member in said locked mode.

4. The connector assembly of claim 3 wherein said at least one lever is pivotally attached to said connector housing between a front end of said connector housing and an opposite rear end of said connector housing, said first end extending towards said front end and said second end extending towards said rear end.

5. The connector assembly of claim 4 wherein said slider comprises a finger pad.

6. The connector assembly of claim 5 further comprising a conductor strain relief member removably engagable with said connector housing at said rear end.

7. The connector assembly of claim 6 wherein said conductor strain relief member comprises at least one arcuate portion structured and arranged to effect strain relief by trapping a contact extended therethrough.

8. The connector assembly of claim 7 wherein said connector housing comprises first latch elements and said conductor strain relief member comprises second latch elements each structured and arranged to engage a respective first latch element.

9. The connector assembly of claim 6 wherein said conductor strain relief member comprises at least one lever abutment surface structured and arranged to limit pivotal movement of said at least one lever.

10. The connector assembly of claim 1 wherein said connector housing comprises a top portion and an opposite bottom portion, and further wherein said at least one lever is pivoted from one of said top portion and said bottom portion and comprises a first length cantilevered towards said first end and a second length cantilevered towards said second end.

11. The connector assembly of claim 1 further comprising a conductor strain relief member removably engagable with said connector housing at said rear end.

12. A connector assembly, comprising:

a connector housing slidably engagable with and disengagable from a mating connector assembly in an engaged mode and disengaged mode, respectively;

at least one resilient lever pivotally attached relative to said connector housing and comprising a first end and an opposite second end, said first end engaging and disengaging said mating connector assembly in said engaged mode and said disengaged mode, respectively;

a slider slidably attached to said at least one lever for sliding between said first end and said second end, said slider being structured and arranged to slide in a first direction to a first position to prevent disengagement of said at least one lever from a mating connector housing, in a locked mode, and to slide in an opposite second direction to a second position to allow pivoting said at least one lever to provide disengagement of said at least one lever from a mating connector housing, in an unlocked mode; and conductor strain relief member removably engagable with a rear end of said connector housing and that comprises a plurality of first portions each structured and arranged to engage a respective outer surface segment of said connector housing, and a plurality of second portions each structured and arranged to engage a respective contact or contact seal between said second portion and a respective inner surface segment of said connector housing.

13. The connector assembly of claim 12 wherein said plurality of second portions is a plurality of first arcuate portions.

14. The connector assembly of claim 13 wherein said plurality of first portions is a plurality of second arcuate portions.

15. The connector assembly of claim 13 wherein said plurality of first portions comprises opposing beams.

16. The connector assembly of claim 13 further wherein said conductor strain relief member further comprises a plurality of channels each of which opens into a respective first arcuate portion and is structured and arranged relative to said respective first arcuate portion to provide an angled pathway for a conductor.

* * * * *